United States Patent [19]

Laumont

[11] Patent Number: 4,525,126

[45] Date of Patent: Jun. 25, 1985

[54] ELECTRO-HYDRAULIC UNIT FOR STEERING, BRAKING, SUSPENSION AND LIKE DEVICES FOR VEHICLES

[75] Inventor: Roger Laumont, La Varenne St Hilaire, France

[73] Assignee: Hydroperfect International H. P. I., Chennevieres, France

[21] Appl. No.: 471,746

[22] Filed: Mar. 3, 1983

[30] Foreign Application Priority Data

Mar. 4, 1982 [FR] France ..... 82 03619

[51] Int. Cl.[3] ..... F04B 47/08; F04C 13/00; B60R 16/08; B62D 5/06

[52] U.S. Cl. ..... 417/310; 417/410; 418/182

[58] Field of Search ..... 417/410, 310; 418/182

[56] References Cited

U.S. PATENT DOCUMENTS

| | | | |
|---|---|---|---|
| 2,634,904 | 4/1953 | Clerc . | |
| 2,678,156 | 5/1954 | Henderson . | |
| 3,014,623 | 12/1961 | Horn et al. | 417/410 X |
| 3,473,475 | 10/1969 | Martini et al. | 417/410 |
| 3,515,167 | 6/1970 | Svenson | 137/565 |
| 4,241,484 | 12/1980 | Graham | 29/156.4 |
| 4,447,192 | 5/1984 | Tuckey | 417/410 |

FOREIGN PATENT DOCUMENTS

| | | |
|---|---|---|
| 2242885 | 3/1975 | France . |
| 987587 | 3/1965 | United Kingdom . |

*Primary Examiner*—Richard E. Gluck
*Attorney, Agent, or Firm*—Browdy and Neimark

[57] ABSTRACT

An electro-hydraulic unit for control devices, particularly for steering devices, braking devices, suspension devices, and like devices comprises an electric motor directly connected to a gear hydraulic pump, said electric motor and hydraulic gear pump having a common interface providing a lateral cheek for the electric motor, this common interface being formed in one part with body of the hydraulic pump.

9 Claims, 5 Drawing Figures

ELECTRO-HYDRAULIC UNIT FOR STEERING, BRAKING, SUSPENSION AND LIKE DEVICES FOR VEHICLES

BACKGROUND OF THE INVENTION

This invention relates to control devices for vehicles and more particularly to hydraulic control devices. None specifically the invention relates to hydraulically actuated steering, braking suspension and like devices for vehicles.

In the art concerning cars, hydraulic control devices for instance for steering mechanisms comprise a hydraulic pump permanently rotated by the main engine of the vehicle and this pump is frequently driven by a belt, supplying hydraulic fluid in a hydraulic accumulator through a circuit including a circuit breaker to limit the pressure in the hydraulic accumulation.

Since the pump supplies permanently pressurized hydraulic fluid which always is caused to come back to a tank even in case of opening of the circuit breaker when the steering or other device is not actuated it results a substantial power consumption which is heat dissipated. Further to actuate the steering device of the vehicle it is necessary for the main engine to rotate. Furthermore the outflow of the pumps increases with the rotational speed of the main engine while the power to be developed to control the steering device of the vehicle is more important when the main engine slowly rotates, i.e. when the driver of the vehicle is rolling at low speed particularly for parking.

The invention resolves the above problems by providing an electro-hydraulic unit for control devices, particularly for steering devices braking devices, suspension devices and like devices comprising an electric motor directly connected to a gear hydraulic pump, said electric motor and hydraulic gear pump having a common interface providing a lateral cheek for the electric motor, this common interface being formed in one part with body of the hydraulic pumps.

PRIOR ART

It is known in the art to directly connect an electric motor and a hydraulic pump. Such a connection is related in U.S. Pat. No. 4,241,484 in which an electric motor is connected to an intermediate part to which is connected a hydraulic pump directly driven by the shaft of the electric motor. This is also the object of U.S. Pat. No. 2,678,156 which relates an electric motor connected by means of screws to plugs located inside the body of a hydraulic pump of the blade type.

In a same manner U.S. Pat. No. 3,515,167 concerns an electric motor connected on the side of a plate which constitute a support for a body of a hydraulic pump and for a casing surrounding the body of the hydraulic pump and containing the hydraulic fluid.

Similarly British Pat. No. 987,587 relates an electric motor secured by means of screws to an intermediate part carrying bearings and a connecting unit for the driving of a pump which is fixedly connected to the intermediate part.

French Pat. No. 2,476,222 relates a fuel pump constituted by a pilling of pieces having the shape of plates which are secured on one side of an electric motor.

French Pat. No. 2,242,885 has also for its object a unit comprising a hydraulic pump secured to a plate used itself as support for a hydraulic motor.

Further French Pat. No. 2,248,730 describes an electric pump for liquids having a high electrical resistance and directly driven by an electric motor. This is still the case of German Pat. No. 1,200,136 of which an electric motor is connected to a blowing centrifugal wheel, of U.S. Pat. No. 2,634,904 of which a blade type pump is positioned against a driving motor, and of French Pat. No. 2,039,095 which concerns a rotative pump.

The invention has for object to provide:

a new unit for the control of the steering device of a vehicle which is powered only during the operation of said steering device;

a unit which is of small size so that it may be located in a small place and which may operate in any or all position;

a unit which may control various means, for instance the steering device, even in case the main engine does not rotate. This feature enables particularly the actuation and rotation of wheels of a stopped vehicle to put them at an angle which corresponds to the locking angle of an anti-theft mechanism, and eliminating the need of the driver to develop an additional force. Similarly when the electro hydraulic unit of the invention is used for instance for the control of the suspension device of a vehicle, it becomes possible to raise the vehicle and/or the wheels of this vehicle after the positioning of an upright under the vehicle without rotating the main engine of the vehicles;

a unit which comprises only a few number of parts so that it is economical to manufacture.

BRIEF DISCLOSURE OF THE DRAWINGS

Other objects and further features of the present invention will be apparent from the following detailed description when read in conjunction with the accompanying drawings, wherein FIG. 1 is a diagrammatic view of a vehicle steering control device embodying the electro-hydraulic unit of the invention, FIG. 2 is a longitudinal elevation cross-section of an embodiment of the electro-hydraulic unit of the invention;

DESCRIPTION OF A PREFERRED EMBODIMENT

Figure 1:
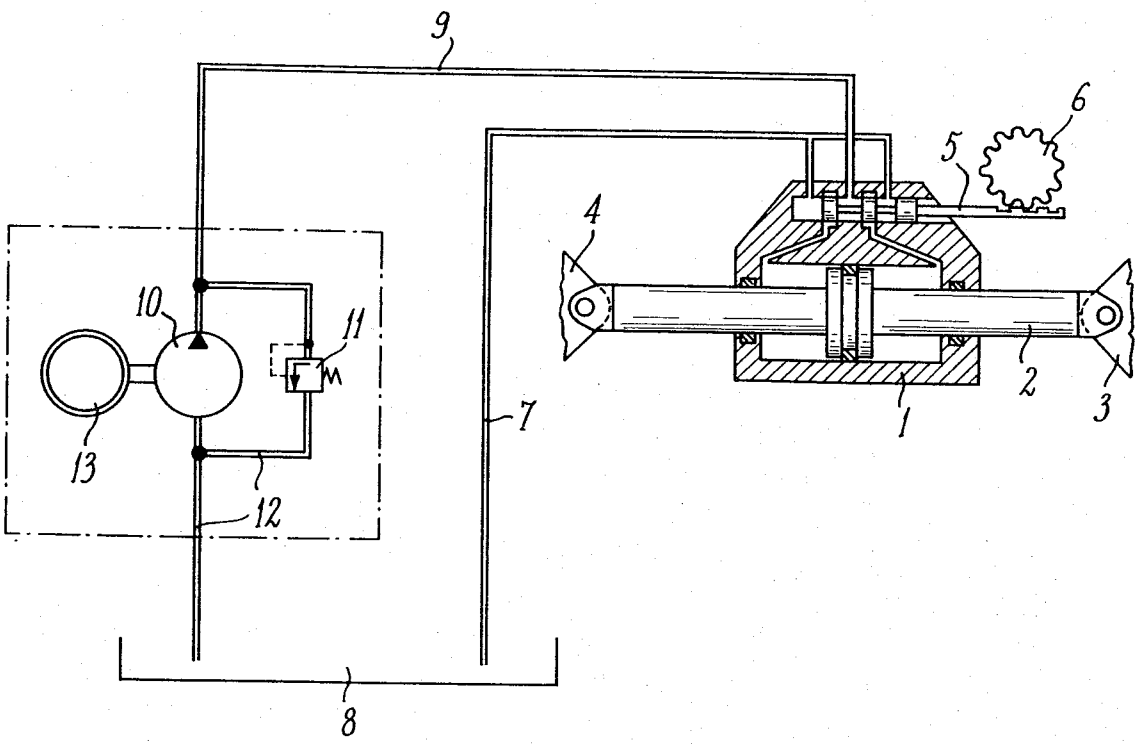

FIG. 1 shows diagrammatically a hydraulic control device for the steering of a vehicle. The device comprises a double action hydraulic cylinder 1 having a piston rod 2 controlling steering rods 3, 4. The chambers of the hydraulic cylinder 1 are fed in a known manner by a slide-valve 5 activated by a pinion 6 of the steering rod. The body of the slide valve 5 is connected by a pipe 7 to a tank 8 containing a control liquid maintained under a small over-pressure, for example about the atmospheric pressure, and by a pipe 9 to the outlet of an hydraulic pump 10 which is short-circuited by an over-pressure valve 11 having an outlet 12 conducting to the tank 8.

According to the invention, the hydraulic pump 10 is directly coupled to an electric motor 13.

Figure 2:
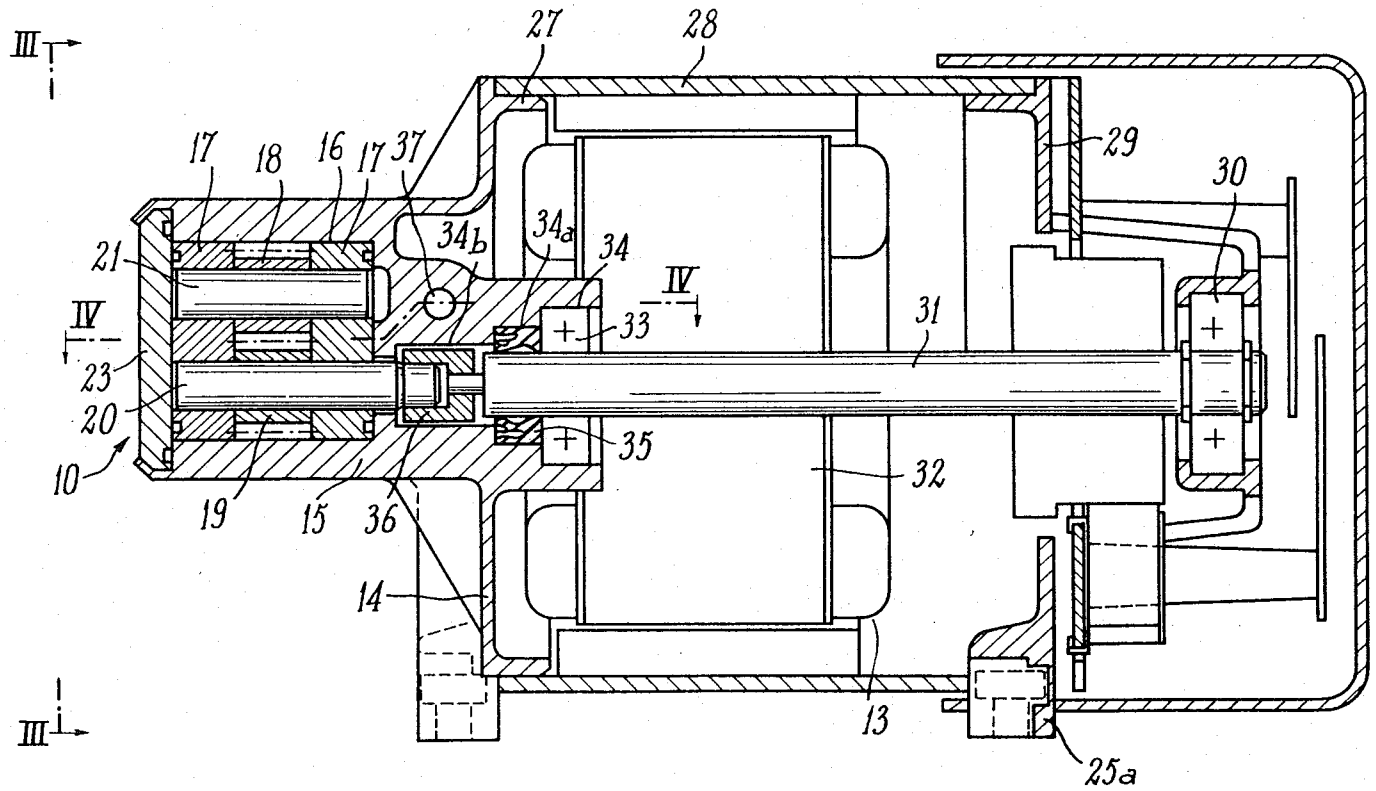
Figure 3:
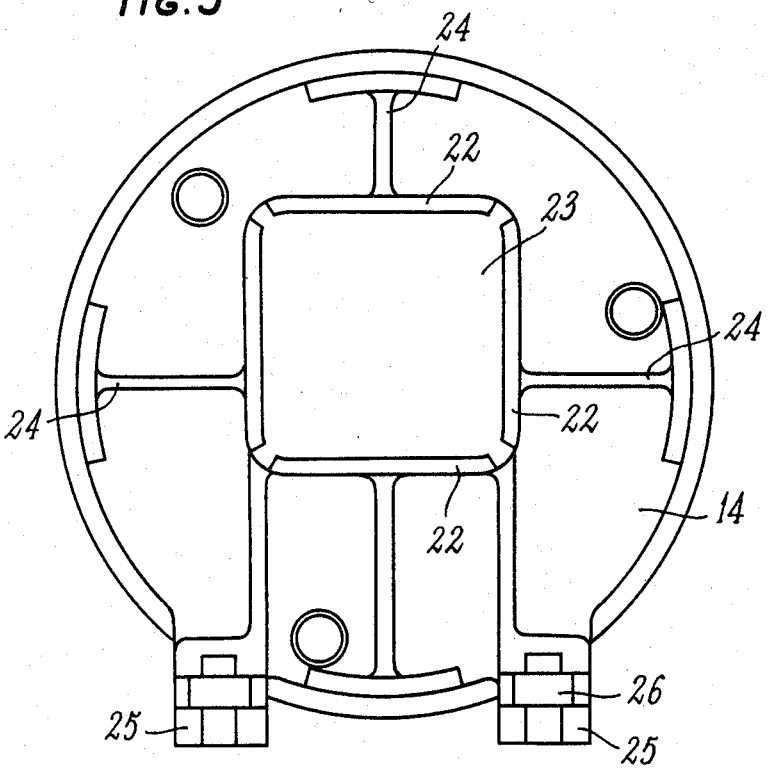
FIG. 3 is a front elevation view taken along line III—III of FIG. 2.

FIG. 2 shows an advantageous embodiment of the invention according to which one of the lateral cheeks 14 of the electric motor 13 is formed from the body 15 of the hydraulic pump 10, so that the electric motor 13 and the hydraulic pump 10 comprises a common wall.

The body 15 and the cheek 14 are manufactured for example by a molding process or by dieing process from a non-magnetic metal. The pump insidely forms a bore 16 in which are placed two bearings 17 for supporting gears 18, 19 of the pump. The gears are mounted on shafts 20 and 21 inserted in the bearings 17.

The body 15 of the pump advantageously forms at the free end thereof crimping lugs 22 for a cover 23.

Manufacturing the body 15 and the cheek 14 by a molding of dieing process makes also possible to form, on the one hand, reinforcing gussets 24, and on the other hand, fixing poles 25 provided with recesses 26 for positioning bolts or screws.

The cheek 14 forms also a bearing surface 27 for positioning a housing 28 forming a yoke for the electric motor 13. At its other end the housing 28 is closed by a second cheek 29 which supports the various attachments of the electric motor 13 as well as a bearing 30 for the shaft 31 of its rotor 32. The rotor 32 is, besides, supported in a second bearing 33 placed in a stepped bore 34 made at the rear part of the body 15 of the hydraulic pump 10. The bore 34 comprises in a part 34*a* a sealing gasket 35 and, in a part 34*b*, a connecting nut 36 for compensating possible alignment defects between the shaft 31 of the electric motor 13 and the shaft 20 of the hydraulic pump 10.

The body 15 of the hydraulic pump 10 forms also a second stepped bore 37, preferably provided with truncated segments, which communicates through channels 38 and 39 respectively with ducts 40 and 41 which are made in the bearings 17 and which are respectively in communication with the inlet pipe 42 and the supplying pipe 43 of the hydraulic pump 10.

The enlarged truncated part 37*a* of the bore 37 comprises a cartridge 44 which is interiorly provided with a spring 45 urging on a ball valve 46 into seating engagement with a seat 47. The spring is maintained by a crimped cover 48 and the cartridge is itself crimped by a collar 49 formed for this effect in the side wall of the body 15 of the hydraulic pump.

Figure 4:
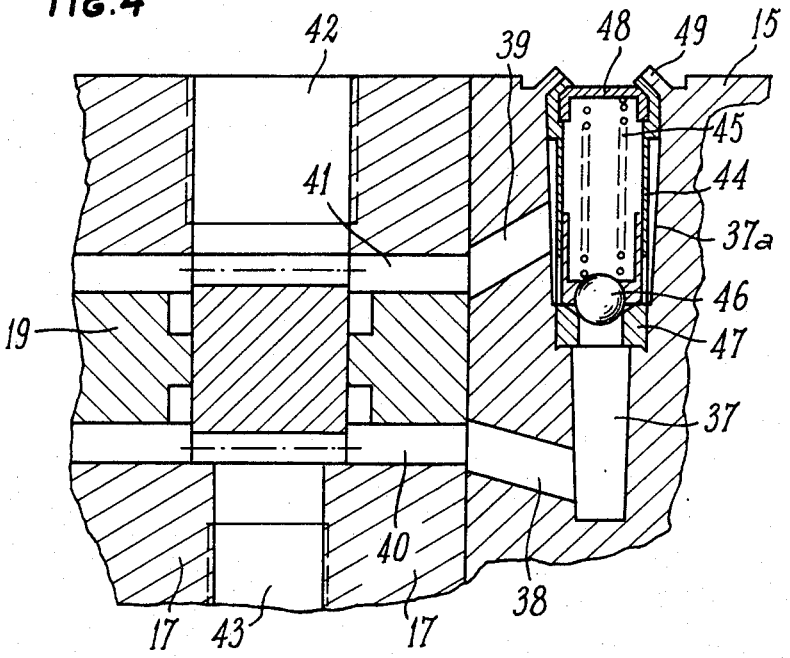
FIG. 4 is a cross section taken along line IV—IV of FIG. 2.

As shown in FIG. 4 in case of an over-pressure in the supplying part of the pump, the fluid passes through the duct 40, the channel 38, the bore 37 and raises the valve 46 against action of the spring 45 whereupon the fluid 13 returned through the channel 39 and the duct 41 to inlet of the pump.

The embodiment as above described shows that by the arrangement according to the invention, the overpressure valve 11 described in reference to FIG. 1 is fully fixed to the body 15 of the hydraulic pump 10 which forms simultaneously one of the cheeks of the motor and a part of the fixing poles of the electro-hydraulic unit, the other fixing poles 25*a* being formed by the second cheek 29.

Figure 5:
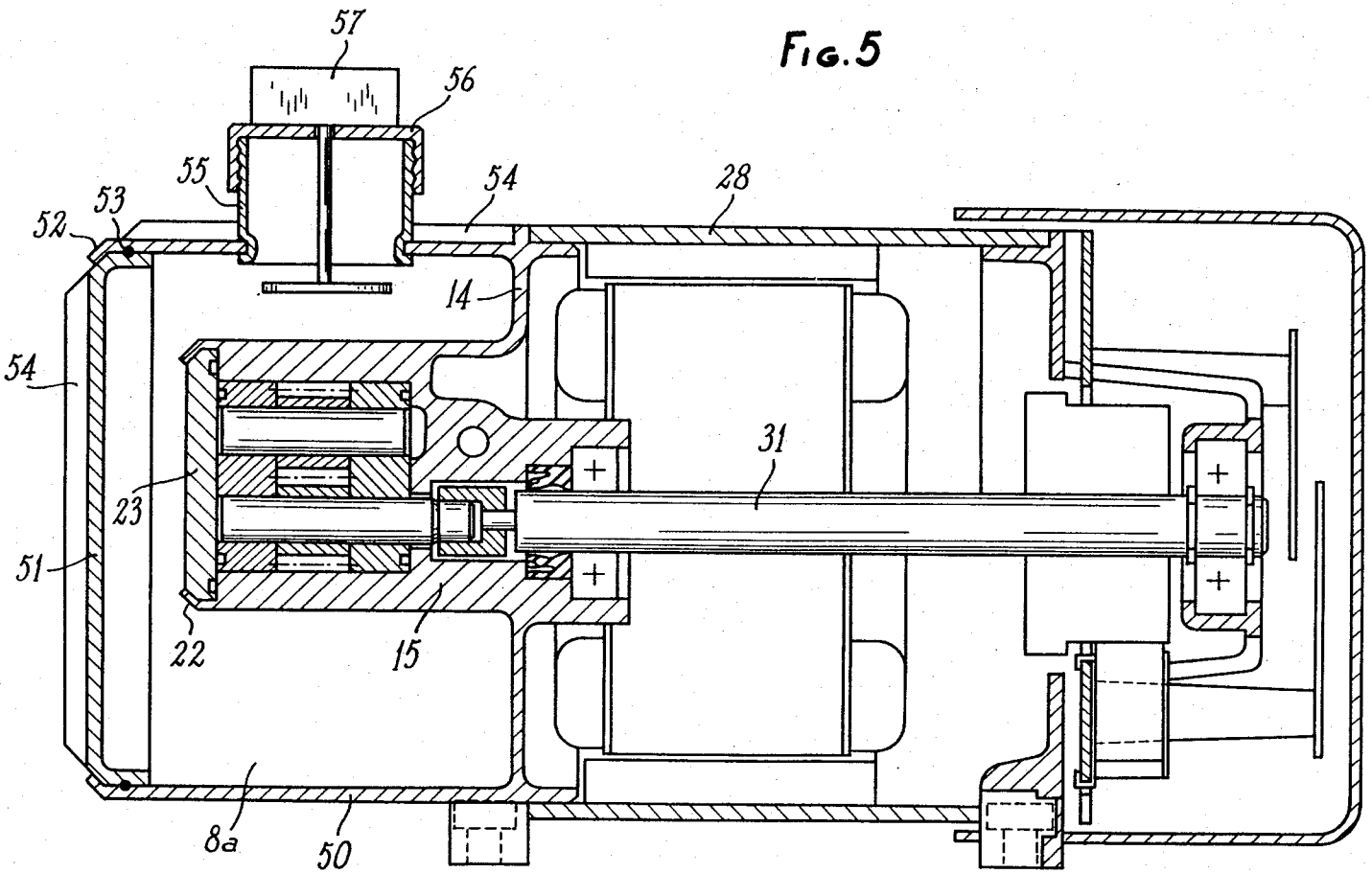
FIG. 5 is a cross-elevation view similar to FIG. 2 of a variant.

FIG. 5 shows a variant according to which the body 15 of the hydraulic pump 10 forms, as previously, the cheek 14 of the motor and, moreover, a housing 50 which fully surrounds the body 15 of the hydraulic pump 10. The housing 50 forms with the body 15 of the hydraulic pump 10 made exactly as described in FIG. 2 a tank 8*a* for the liquid under a low over-pressure which feeds the pump and the cylinder 1 (FIG. 1). The housing 50 is for example closed by a cover 51 which is crimped as shown at 52. A sealing gasket 53 is advantageously placed between the housing 50 and the cover 51, both of which may be provided with cooling fins 54, thus forming a secondary heat exchange element.

The housing 50 supports also the feeding base 55 having a closing plug 56 provided with a level detector 57.

The above arrangement is advantageous since it permits maintaining the entire body of the pump at a uniformeous temperature which eliminates any risk of differential heat expansion and provides a particularly safe working for the hydraulic pump.

Although this has not been shown, in another variant, the housing 28 of the electric motor can be made sealtight, the motor being made substantially as the motor used in the accelerators for liquids of central heating units.

In this case, the housing of the motor can also form a tank for the circulation liquid of the hydraulic pump.

Further the present invention is not limited to the embodiments shown and described in detail, but various variations and modifications may be made without departing of the scope of the present invention. In particular, the drawings show an electric motor with a coiled rotor which constitutes only an example, the electric motor can also be a motor with a plane or bell rotor. Samely, the motor can be of a double rotation direction.

I claim:

1. An electro-hydraulic unit for control devices of vehicles, comprising an electric motor and a hydraulic pump of the gear type, said electric motor having a driving shaft and said hydraulic pump having a driven shaft with said hydraulic pump being driven by the driving shaft of said electric motor and connected to said electric motor, said electric motor and said hydraulic pump having a common interface portion constituting a lateral cheek for said electric motor, and said common interface portion delimiting further a body for said hydraulic pump and having an inner stepped bore, a bearing for supporting said driving shaft of said electric motor, a sealing member surrounding said driving shaft of said electric motor, said bearing and sealing member located in two stepped contiguous portions of said stepped bore, a connecting nut located in a third stepped portion of said stepped bore for connection of said driving shaft of said electric motor with the driven shaft of said hydraulic pump, said common interface portion having further a recessed bore and channels connecting inlet and outlet ducts of said hydraulic pump with an overpressure valve located in said recessed bore for control of pressure of the outlet of said pump.

2. The unit of claim 1, wherein the overpressure valve is formed by a cartridge directly maintained within the body of the hydraulic pump.

3. The unit of claim 1, wherein the body of the hydraulic pump is closed by a cover.

4. The unit according to claim 2, wherein the cartridge containing the over pressure valve is maintained in place by a crimping of the body of the hydraulic pump.

5. The unit of claim 1, wherein the lateral cheek forms fixing poles of the entire unit.

6. The unit of claim 1, wherein a housing is formed from a periphery of the lateral cheek, said housing surrounding completely the body of the hydraulic pump and containing a liquid for feeding said hydraulic pump which is thus bathed in the liquid feeding said hydraulic pump.

7. The unit of claim 6, wherein at least the housing forms secondary heat exchange elements of the fin type.

8. The unit of claim 6, wherein the housing is closed by a cover and comprises a feeding base.

9. A unit of claim 8, wherein the feeding base of the housing is provided with a level detecting plug.

* * * * *